US006332480B1

(12) United States Patent
Best

(10) Patent No.: US 6,332,480 B1
(45) Date of Patent: Dec. 25, 2001

(54) PAPER MACHINE CLOTHING HAVING LOOP-FORMING LONGITUDINAL THREADS, AT ITS ENDS

(75) Inventor: Walter Best, Duren (DE)

(73) Assignee: Thomas Josef Heimbach Gesellschaft mit beschrankter Haftung & Co. (DE)

( * ) Notice: Subject to any disclaimer, the term of this patent is extended or adjusted under 35 U.S.C. 154(b) by 0 days.

(21) Appl. No.: 09/572,321

(22) Filed: May 18, 2000

(30) Foreign Application Priority Data

May 20, 1999 (DE) ..... 199 23 088

(51) Int. Cl.[7] ..... D21F 7/10
(52) U.S. Cl. ..... 139/383 AA; 162/902
(58) Field of Search ..... 139/383 AA; 162/902

(56) References Cited

U.S. PATENT DOCUMENTS 4,401,137 * 8/1983 Cannon ..... 139/383 AA
4,438,789 3/1984 MacBean .
5,089,324 2/1992 Jackson .
5,188,884 * 2/1993 Smith ..... 139/383 AA
5,405,669 * 4/1995 Lidar ..... 139/383 AA
5,458,161 * 10/1995 Scarfe ..... 139/383 AA

FOREIGN PATENT DOCUMENTS 0609664 1/1994 (EP) .
0532510 11/1994 (EP) .

* cited by examiner

*Primary Examiner*—Andy Falik
(74) *Attorney, Agent, or Firm*—Liniak, Berenato, Longacre & White, LLC

(57) ABSTRACT

A paper machine fabric has a paper side and a machine side facing away from the paper side. The fabric comprises a plurality of cross direction threads and machine direction threads. Each machine direction thread has a first portion woven with the cross direction threads, a loop, and a second portion adjacent the first portion and woven with the cross direction threads, with the loop connecting the first and second portions. Each first portion is adjacent to a first portion of an adjacent machine direction thread. The first portions have a same first repeated weaving pattern, each one of which is in phase. Each second portion is adjacent to a second portion of an adjacent machine direction thread. The second portions have a same second repeated weaving pattern, each one of which is in phase. The first repeated weaving pattern differs from the second repeated weaving pattern.

17 Claims, 2 Drawing Sheets

PAPER MACHINE CLOTHING HAVING LOOP-FORMING LONGITUDINAL THREADS, AT ITS ENDS

FIELD OF THE INVENTION

The invention concerns a paper machine clothing, in particular as a dryer fabric, having a paper side provided for the support of a paper web and a machine side facing away therefrom, the paper machine clothing having or comprising a fabric made of longitudinal and transverse threads, and each two adjacent longitudinal threads engaging at the same height with transverse threads to form a longitudinal thread pair.

BACKGROUND

A dryer fabric of this kind is disclosed in EP 0 609 664 A1. It comprises a single-ply fabric having round transverse threads that can also be configured as hollow monofilaments, and having two longitudinal thread systems, the longitudinal threads being embodied as flat monofilaments. One of the longitudinal thread systems extends predominantly on the paper side, each two adjacent longitudinal threads forming a longitudinal thread pair that engages at the same height with the transverse threads. With the second longitudinal thread system, one longitudinal thread runs in each case below a longitudinal thread pair.

If dryer fabrics such as those evident from EP 0 609 664 A1 are woven flat, their length is finite, so that after installation into the paper machine their ends must be joined together. EP 0 609 664 A1 contains nothing concerning the manner in which this occurs with the dryer fabric disclosed therein.

It is known in the existing art to join the ends of paper machine fabrics using a so-called inserted wire seam. For this purpose, eye-forming loops are configured at the ends and are made to overlap when the edges are fitted together, so that the eyes of the loops of the two ends align and consequently form a passage into which an inserted wire can be slid. This inserted wire couples the eyes of the two ends, and thus makes the paper machine clothing endless.

In many cases the longitudinal threads of the paper machine fabrics are utilized to form the loops, by the fact that some of the longitudinal threads are guided out beyond the last transverse threads and woven back into the fabric forming an eye, while others of the longitudinal threads are woven back in directly, i.e. without forming an eye (cf. U.S. Pat. Nos. 5,089,324, 4,438,789). With the fabrics disclosed in these documents, the weaving back is accomplished in such a way that the woven-back portion of the respective longitudinal thread is engaged next to the latter, and the profile of this portion does not deviate from that of the longitudinal thread in question. In the paper machine fabric described in EP 0 532 510 B1, the woven-back portion is introduced back into the fabric below the relevant longitudinal thread so that the loops are not subject to twisting.

It is the object of the invention to configure the ends of a paper machine clothing of the kind cited initially, for the purpose of creating an inserted-wire seam, in such a way that the weave pattern is consistent, in particular on the paper side, over the entire length of the paper machine clothing .

SUMMARY OF THE INVENTION

According to the present invention, this object is achieved in that at each of the ends of the paper machine clothing, the longitudinal threads of a longitudinal thread pair form a loop with the adjacent longitudinal threads of the adjacent longitudinal thread pair. The basic idea of the invention is thus to weave back the longitudinal thread structure of the loops in such a way that the longitudinal threads which belong together as the result of a loop run adjacently but belong to two different adjacent longitudinal thread pairs. In this type of longitudinal thread system, each of the two longitudinal threads in a given longitudinal thread pair has a same repeated weaving pattern that is in phase. This type of longitudinal thread guidance guarantees a uniform weave pattern on the paper side over the entire length of the paper machine clothing, at the same time forming loops for an inserted wire seam. The properties of the paper machine clothing are therefore influenced over the entire length by the paired guidance of the longitudinal threads.

In an embodiment of the invention, it is provided that alternately one loop is laid closely around the last transverse thread, and one loop is of pulled-out configuration to form a loop eye. Instead of this, all the loops can also be of pulled-out configuration in order to form a loop eye.

In a further embodiment of the invention, it is provided that adjacent longitudinal thread pairs engage the transverse threads in opposite directions. If some or all of the transverse threads are configured as flat transverse threads, the longitudinal thread pairs should each engage only one of the flat transverse threads.

According to a further feature of the invention, it is provided that in each case at least two transverse threads configured as round transverse threads lie in contact on the machine side of at least some of the transverse threads configured as flat transverse threads, and in each case one flat transverse thread and its round transverse threads lying in contact with it are together engaged by at least some of the longitudinal threads. This configuration is characterized by particular dimensional stability.

It is not necessary for the round transverse threads lying in contact with one flat transverse thread on the machine side to lie in contact with one another. Shifting of the round transverse threads with respect to the flat transverse threads is reduced, however, if the round transverse threads touch one another. In this context, the sum of the diameters of the round transverse threads that lie in contact with one flat transverse thread should not be greater than its extension in the longitudinal direction, so that the round transverse threads do not project beyond the flat transverse threads.

In a further embodiment of the invention, it is provided that no further transverse threads are present besides the flat transverse threads and the round transverse threads lying in contact with them, i.e. that what is always present is a combination of flat transverse threads and round transverse threads supporting them. As an alternative to this, however, it can also be provided that some of the longitudinal threads engage the flat transverse threads only on the paper side, and otherwise engage only with round transverse threads that extend between the round transverse threads lying in contact with the flat transverse threads.

As an alternative to the combination described above of flat and round transverse threads, it is provided tat at least some of the transverse threads are configured as flat transverse threads onto which are shaped longitudinal ribs projecting on the machine side, the longitudinal ribs extending in the direction of the longitudinal axis of the flat transverse threads. This feature again provides dimensional stability for the transverse threads and ensures that the smooth paper-side surface of the flat transverse threads remains as flat as possible and thus supports the paper web over the largest possible area. Flat transverse threads of this kind can be manufactured by extrusion of the plastic material that is used.

The longitudinal ribs can be adapted to the respective requirements and manufacturing capabiliities, and within this context can have any desired cross section. Rectangular, trapezoidal, and/or round cross sections are particularly appropriate. The number of longitudinal ribs is in principle not limited. Particularly favorable conditions are created if two or three longitudinal ribs are shaped next to one another.

The flat transverse threads advantageously have an extension in the longitudinal direction (machine direction) of the paper machine clothing of 1 to 25 mm, preferably 10 to 15 mm, and in the thickness direction (perpendicular to the plane of the paper machine clothing) of 0.2 to 1 mm. By definition, however, the term "flat transverse reads" always encompasses only those in which the thickness is less than the extension in the longitudinal direction of the paper machine clothing. The longitudinal threads can also be configured as flat threads. In this case the extension in the transverse direction of the paper machine clothing (width) should range from 0.5 to 5 mm, and in the thickness direction from 0.2 to 1 mm.

In order largely to prevent any shifting of the round transverse threads with respect to the flat transverse threads supported by them, the longitudinal threads should each engage only one flat transverse thread, i.e. somewhat in the manner of a plain weave, if the combination of flat and round transverse threads is viewed as a unit.

Materials appropriate for the longitudinal threads are, in particular, PET hydrolysis-stabilized polyester, PPS, PEEK, and PCTA. The materials suitable in particular for the transverse threads are PET hydrolysis-stabilized polyester, PPS, polysulfone, PEEK, PCTA, and PEN.

BRIEF DESCRIPTION OF THE DRAWINGS

FIG. 4 shows a longitudinal section through a dryer fabric that is modified, as compared to the dryer fabric shown in FIGS. 1 and 2, in terms of the transverse threads.

DETAILED DESCRIPTION OF THE INVENTION

Figure 1:
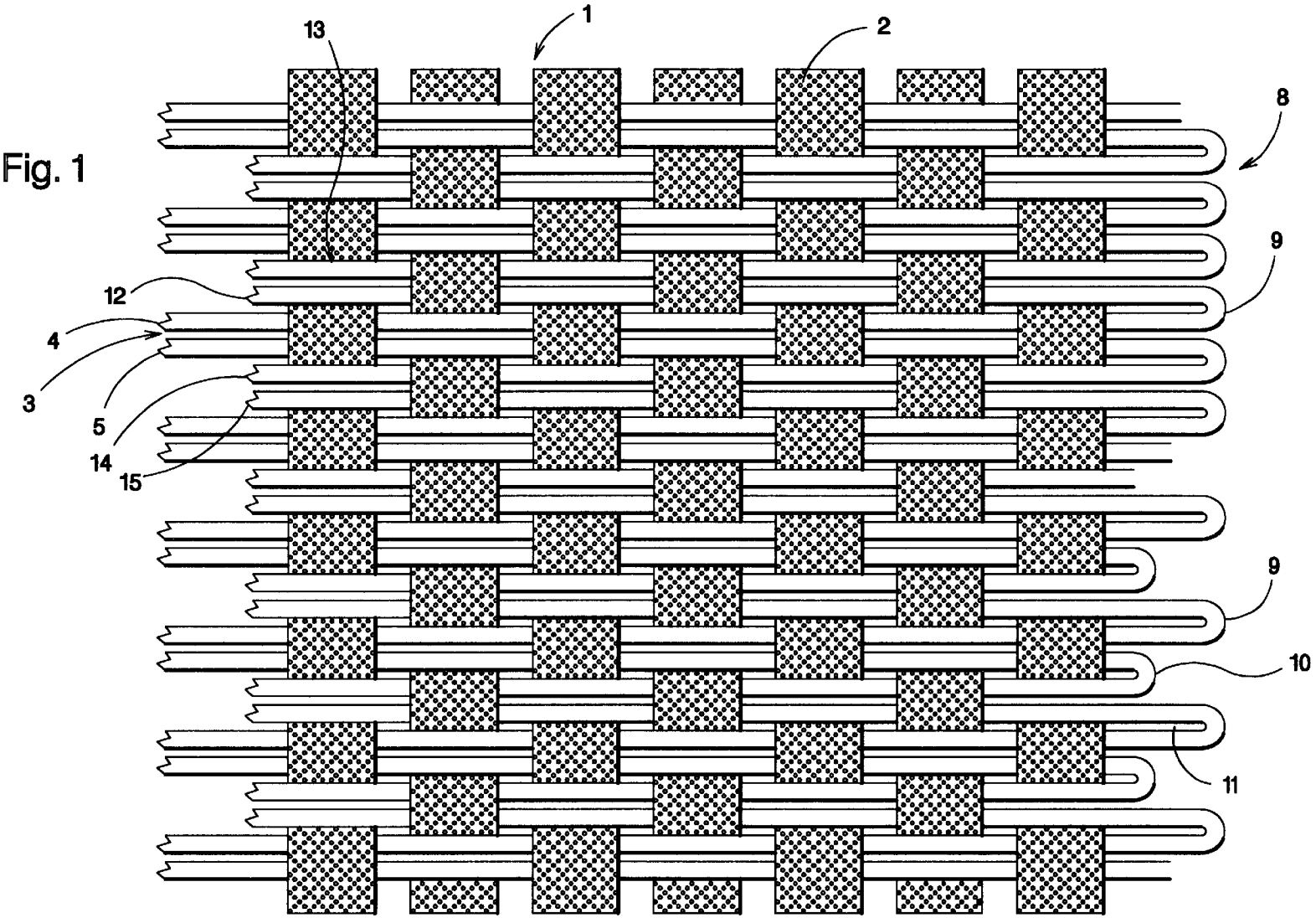
FIG. 1 shows a plan view of the end portion of a dryer fabric.

It is evident from the plan view in FIG. 1 that dryer fabric 1 has on the paper side wide flat transverse threads (labeled 2 by way of example) that are engaged by longitudinal thread pairs (labeled 3 by way of example), each longitudinal thread pair 3 comprising two longitudinal threads (labeled 4, 5 by way of example) that extend at the same height within a longitudinal thread pair 3. Longitudinal thread pairs 3 engage with flat transverse threads 2 in the manner of a plain weave, i.e. they engage one flat transverse thread 2 on the paper side and the following flat transverse thread 2 on the machine side and then once again the subsequent flat transverse thread 2 on the paper side.

Figure 2:
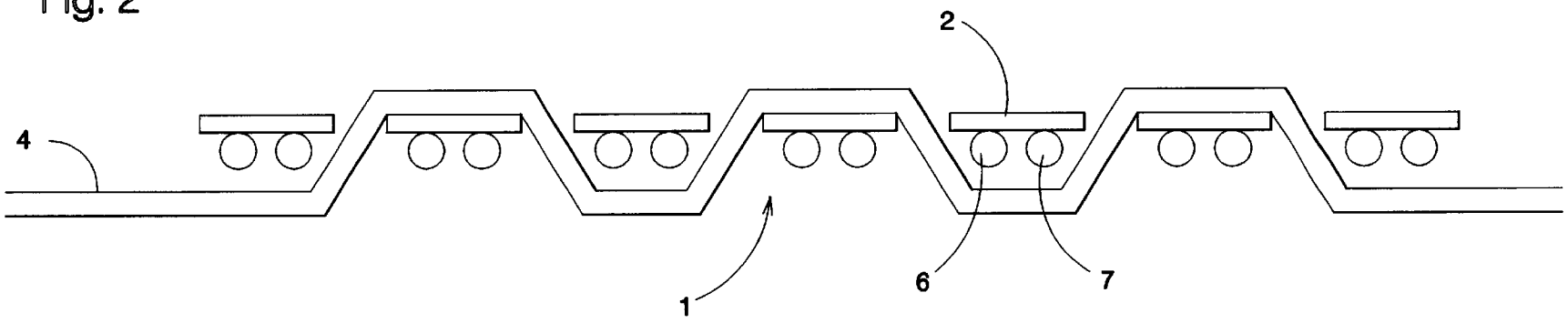
FIG. 2 shows a longitudinal section through the portion shown in FIG. 1.

The engagement of longitudinal threads 4, 5 with flat transverse threads 2 is even more clearly evident from FIG. 2. This Figure shows that two round transverse threads (labeled 6, 7 by way of example) lie in contact with the underside of each flat transverse thread 2 and support it in paired fashion. Any shifting of round transverse threads 6, 7 relative to flat averse threads 2 is prevented by the alternating engagement of flat transverse threads 2 and the associated round transverse threads 6, 7 by longitudinal thread pairs 3.

In the version below the dot-dash line, longitudinal threads 4, 5 of longitudinal thread pairs 3 form, at end 8 of dryer fabric 1, large loops (labeled 9 by way of example) and small loops (labeled 10 by way of example). Large loops 9 alternate with small loops 10. The version above the dot-dash line illustrates only large loops 9. It is understood that this depiction is intended to show two different types of end 8, but that only one version of the loops is present in one dryer fabric. Large loops 9 form loop eyes 11; these loops 9 can be made to overlap with corresponding large loops at the other end of dryer fabric in such a way that all the loop eyes 11 align and thus form a passage through which, in known fashion, an inserted wire can be slid in order to join ends 8 and form a so-called inserted wire seam.

The special aspect of the loop configuration is principally the fact that after the loop has been formed, one longitudinal thread 4 of a longitudinal thread pair 3 is woven back in such a way that it forms the adjacent longitudinal thread 12 of the adjacent longitudinal thread pair 13. The same is true of longitudinal thread 5 of longitudinal thread pair 3, i.e. as a result of formation of the loop, it becomes the adjacent longitudinal thread 14 of the adjacent longitudinal thread pair 15. The result is that there is little twisting of loops 9, 10, and dryer fabric 1 has a highly uniform weave pattern on the paper side.

Figure 3:
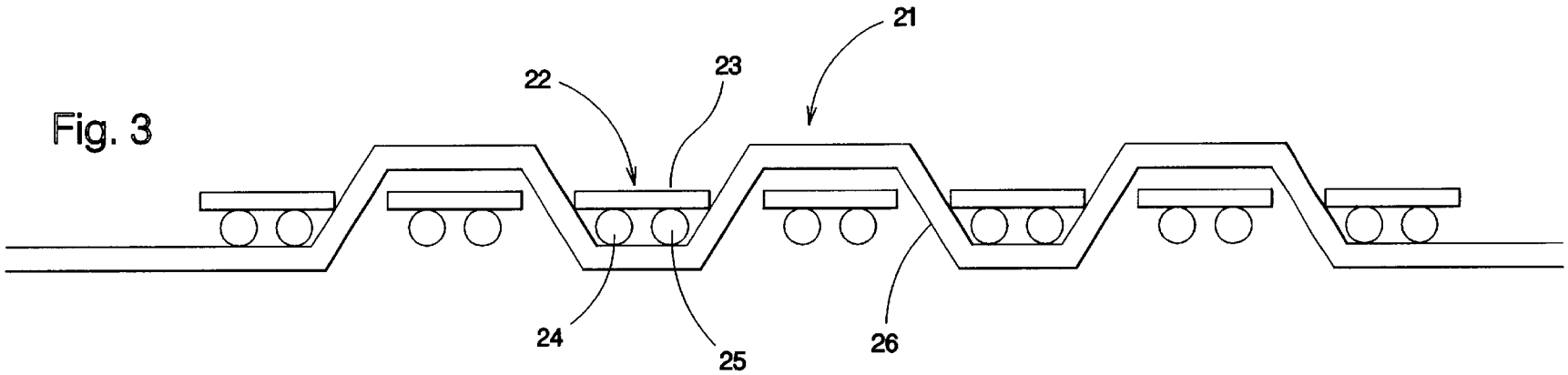
FIG. 3 shows a longitudinal section through a dryer fabric that is modified, as compared to the dryer fabric shown in FIGS. 1 and 2, in terms of the transverse threads.

Dryer fabric depicted in FIGS. 3 and 4 differs from dryer fabric 1 according to FIGS. 1 and 2 only in terms of the configuration of the transverse threads (labeled 22, 27 by way of example). These transverse threads 22, 27 are configured as one-piece shaped cords. Each transverse thread 22, 27 has on the paper side one flat transverse thread 23, 28 onto whose machine side two longitudinal ribs 24, 25, 29, 30 are shaped next to one another. Longitudinal ribs 24, 25 have a substantially circular cross section, and increase the flexural strength of the respective flat transverse threads 23. Longitudinal ribs 29, 30 have a substantially rectangular cross section, and also increase the flexural strength of the respective flat transverse threads 28.

Transverse threads 22, 27 are engaged by longitudinal threads 26, 31 in the same way as the combination, in dryer fabric 1 shown in FIGS. 1 and 2, of flat transverse threads 2 and round transverse threads 6, 7 lying in contact with them on the machine side.

What is claimed is:

1. A paper machine clothing having a paper side provided for the support of a paper web and a machine side facing away therefrom and having ends, the paper machine clothing (1) comprising a fabric made of longitudinal threads (4, 5, 12, 14, 26) and transverse threads (2, 6, 7, 22), longitudinal thread pairs (3) being formed by two adjacent longitudinal threads (4, 5, 26) each engaging said transverse threads (2, 6, 7, 22) with a same repeated weaving pattern, said repeated weaving patterns of said two adjacent longitudinal threads of each one of said longitudinal thread pairs being in phase, wherein at each of the ends of the paper machine clothing (1, 21), a longitudinal thread (4, 5, 26) of each longitudinal thread pair (3) forms a loop (9, 10) with an adjacent longitudinal thread (12, 14) of an adjacent longitudinal thread pair (13, 15).

2. The paper machine clothing as defined in claim 1, wherein alternately one loop (10) is laid closely around a last transverse thread (2, 6, 7, 22), and one loop (9) is of pulled-out configuration to form a loop eye (11).

3. The paper machine clothing as defined in claim 1, wherein each of said loops (9) are of pulled-out configuration in order to form loop eyes (11).

4. The paper machine clothing as defined in claim 1, wherein each transverse thread is crossed over by a longitudinal thread pair as adjacent longitudinal thread pairs cross under.

5. The paper machine clothing as defined in claim 1, wherein each of said longitudinal thread pairs (3, 13, 15) engage only one of said transverse threads configured as flat transverse threads (2, 23) on one of said sides before crossing over to another one of said sides.

6. The paper machine clothing as defined in claim 1, wherein in each case at least two transverse threads configured as round transverse threads (6, 7) lie in contact on said machine side with at least some of said transverse threads configured as flat transverse threads (2), and in each case one flat transverse thread (2) and corresponding round transverse threads (6, 7) lying in contact with said one flat transverse thread (2) are together engaged by at least some of said longitudinal threads (4, 5, 12, 14).

7. The paper machine clothing as defined in claim 6, wherein said round transverse threads (6, 7) lying in contact with one flat transverse thread (2) on said machine side lie in contact with one another.

8. The paper machine clothing as defined in claim 6, wherein a sum of diameters of each round transverse threads (6, 7) that lies in contact with one flat transverse thread (2) is no greater than its extension in a longitudinal direction of said paper machine clothing (1).

9. The paper machine clothing as defined in claim 6, wherein no further transverse threads are present besides said flat transverse threads (2) and said round transverse threads (6, 7) lying in contact with said flat transverse threads.

10. The paper machine clothing as defined in claim 6, wherein some of said longitudinal threads engage said flat transverse threads only on said paper side, and otherwise engage only with round transverse threads that extend between said round transverse threads lying in contact with said flat transverse threads.

11. The paper machine clothing as defined in claim 6, wherein said flat transverse threads (2, 23) have an extension in a longitudinal direction of said paper machine clothing (1, 21) of 1 to 25 mm and in a thickness direction of 0.2 to 1 mm.

12. The paper machine clothing as defined in claim 6, wherein said longitudinal threads (4, 5, 12, 14, 26) are configured as flat longitudinal threads.

13. The paper machine clothing as defined in claim 12, wherein said flat longitudinal threads (4, 5, 12, 14, 26) have an extension in a transverse direction of said paper machine clothing (1) of 0.5 to 5 mm, and in a thickness direction of 0.2 to 1 mm.

14. The paper machine clothing as defined in claim 1, wherein at least some of said transverse threads (22) are configured as flat transverse threads (23) onto which are shaped longitudinal ribs (24, 25) projecting on said machine side.

15. The paper machine clothing as defined in claim 14, wherein said longitudinal ribs (24, 25) have a rectangular, trapezoidal, and/or round cross section.

16. The paper machine clothing as defined in claim 14, wherein two or three longitudinal ribs (24, 25) are shaped next to one another.

17. A paper machine fabric having a paper side provided for the support of a paper web and a machine side facing away from the paper side, said paper machine fabric comprising:

a plurality of cross direction threads extending in a cross direction; and a plurality of machine direction threads extending in a machine direction, each machine direction thread having a first portion woven with said cross direction threads, a loop, and a second portion adjacent said first portion and woven with said cross direction threads, said loop connecting said first and second portions of each machine direction thread, each said first portion being adjacent to a first portion of an adjacent machine direction thread, said first portions having a same first repeated weaving pattern, the same first repeated weaving pattern of each two adjacent first portions being in phase, each said second portion being adjacent to a second portion of an adjacent machine direction thread, said second portions having a same second repeated weaving pattern, the same second repeated weaving pattern of each two adjacent second potions being in phase, said first repeated weaving pattern differing from said second repeated weaving pattern.

* * * * *